US010745853B2

(12) United States Patent
Leibman et al.

(10) Patent No.: US 10,745,853 B2
(45) Date of Patent: Aug. 18, 2020

(54) FRAGRANT ADDITIVE RESERVOIR FOR A DRYER APPLIANCE

(71) Applicant: Haier US Appliance Solutions, Inc., Wilmington, DE (US)

(72) Inventors: Alexander B. Leibman, Prospect, KY (US); Nemetalla Salameh, Louisville, KY (US); Zhiquan Yu, Mason, OH (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 171 days.

(21) Appl. No.: 15/938,024

(22) Filed: Mar. 28, 2018

(65) Prior Publication Data

US 2019/0301078 A1 Oct. 3, 2019

(51) Int. Cl.
*D06F 58/20* (2006.01)

(52) U.S. Cl.
CPC ..... *D06F 58/203* (2013.01)

(58) Field of Classification Search
CPC ..... D06F 58/203
See application file for complete search history.

(56) References Cited

U.S. PATENT DOCUMENTS

| | | | | |
|---|---|---|---|---|
| 2,807,893 | A | 10/1957 | Morey | |
| 5,971,367 | A * | 10/1999 | Skelding | A61L 9/03 261/39.1 |
| 6,922,913 | B2 * | 8/2005 | Hood | D06F 58/203 34/595 |
| 8,887,536 | B2 | 11/2014 | Kim et al. | |
| 2013/0192084 | A1 * | 8/2013 | Hill | D06F 35/008 34/427 |
| 2016/0310625 | A1 * | 10/2016 | Hudson | A61L 9/127 |

FOREIGN PATENT DOCUMENTS

| | | | |
|---|---|---|---|
| EP | 2210975 | B1 | 10/2013 |
| EP | 3015589 | A1 | 5/2016 |
| GB | 855289 | A | 11/1960 |
| JP | 03236851 | A * | 10/1991 |
| JP | 2008029579 | A | 2/2008 |
| KR | 100739202 | B1 | 7/2007 |

* cited by examiner

*Primary Examiner* — Jessica Yuen
(74) *Attorney, Agent, or Firm* — Dority & Manning, P.A.

(57) ABSTRACT

A dryer appliance and a method of operating the same to introduce a fragrance into the drying chamber include positioning a reservoir within the cabinet of the dryer appliance. The reservoir contains a fragrant additive and is positioned such that a flow of air may pass through the fragrant additive and into the drying chamber to improve the smell of the drying chamber and articles placed therein. The reservoir may be positioned within the cabinet and covered with a selectively positioned lid or may be placed in fluid communication with an air handler of the dryer appliance to permit the intermingling of the flow of air and the fragrant additive.

19 Claims, 5 Drawing Sheets

FRAGRANT ADDITIVE RESERVOIR FOR A DRYER APPLIANCE

FIELD OF THE INVENTION

The present subject matter relates generally to dryer appliances, and more particularly to systems and methods for introducing scent from fragrant additive into the drying chamber.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Dryer appliances also generally include a heater assembly that passes heated air through the chamber of the drum in order to dry moisture-laden articles disposed within the chamber. This internal air then passes from the chamber through a vent duct to an exhaust conduit, through which the air is exhausted from the dryer appliance. Typically, an air handler or blower is utilized to flow the internal air from the vent duct to the exhaust duct. When operating, the blower may pull air through itself from the vent duct, and this air may then flow from the blower to the exhaust conduit.

In certain situations, it may be desirable to improve the scent of clothes or other articles removed from the dryer after a drying cycle. For example, a user may prefer more fragrant clothes, or the laundry may have been sitting in the drying chamber for an extended period and smells slightly stale or musty. Conventional means of freshening such articles or otherwise improving their smell include placing dryer sheets or other additives within the drying chamber. Alternatively, clothes may be washed and dried again, resulting in excessive energy and water usage.

Accordingly, improved dryer appliances and methods for improving the scent of articles removed from the drying chamber are desirable. More particularly, a simple, low-cost method of introducing scent to a drying chamber of a dryer appliance would be particularly beneficial.

BRIEF DESCRIPTION OF THE INVENTION

Aspects and advantages of the invention will be set forth in part in the following description, or may be obvious from the description, or may be learned through practice of the invention.

In one aspect of the present disclosure, a dryer appliance is provided including a cabinet and a drum rotatably mounted within the cabinet, the drum defining a drying chamber for receipt of clothes for drying. A reservoir is positioned within the cabinet for receipt of a fragrant additive, the reservoir defining one or more openings. An air circulation device urges a flow of air through the one or more openings and into the cabinet.

In another aspect of the present disclosure, a dryer appliance is provided including a cabinet and a drum rotatably mounted within the cabinet, the drum defining a drying chamber for receipt of clothes for drying. An exhaust conduit defines an exhaust passage in fluid communication with the drying chamber and an air handler is operably coupled to the exhaust conduit for urging a flow of air through the exhaust passage. A reservoir is positioned within the cabinet for receipt of a fragrant additive, the reservoir defining and inlet and one or more openings. A bypass conduit provides fluid communication between the exhaust passage and the inlet of the reservoir such that the flow of air passes through the fragrant additive and out the one or more openings of the reservoir into the cabinet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
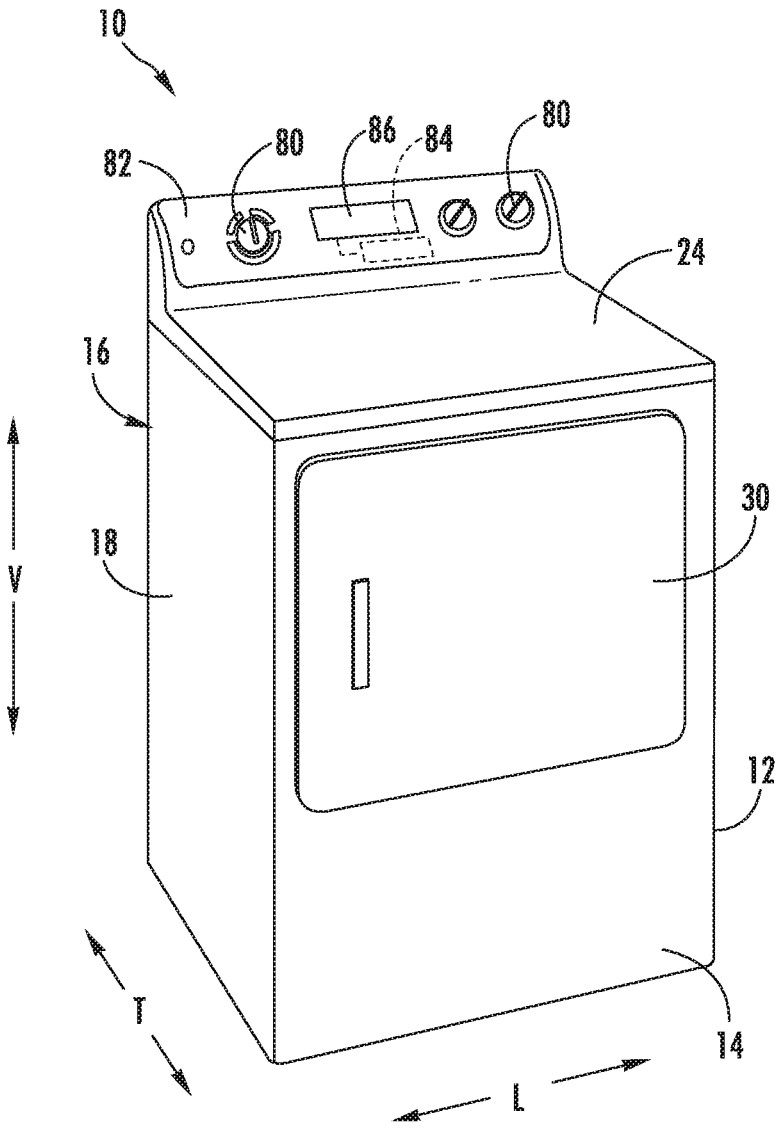
FIG. 1 provides a perspective view of a dryer appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
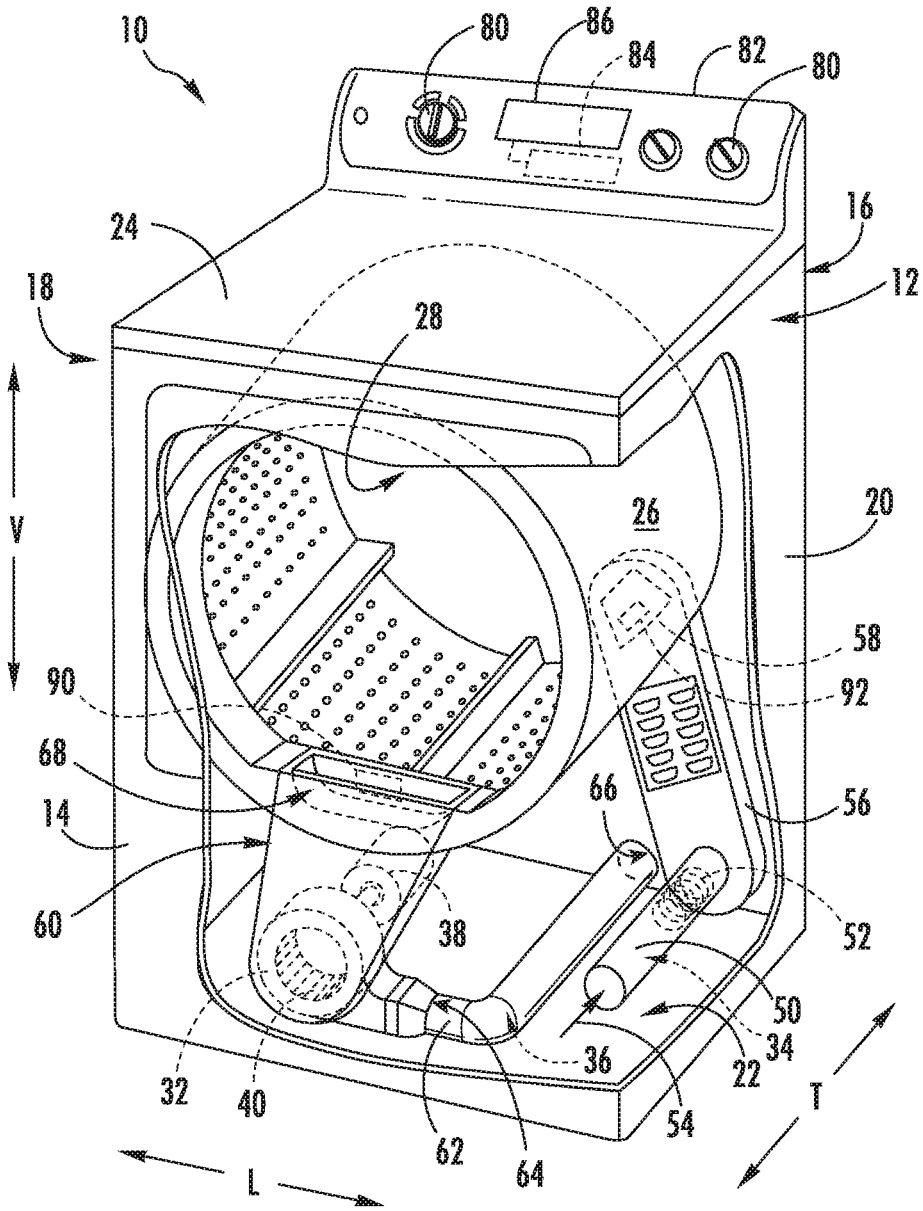
FIG. 2 provides a perspective view of the exemplary dryer appliance of FIG. 1 with portions of a cabinet of the exemplary dryer appliance removed to reveal certain components of the exemplary dryer appliance.

FIG. 1 illustrates a dryer appliance 10 according to an exemplary embodiment of the present subject matter. FIG. 2 provides another perspective view of dryer appliance 10 with a portion of a housing or cabinet 12 of dryer appliance 10 removed in order to show certain components of dryer appliance 10. While described in the context of a specific embodiment of a dryer appliance, using the teachings disclosed herein it will be understood that dryer appliance 10 is provided by way of example only. Other dryer appliances having different appearances and different features may also be utilized with the present subject matter as well.

Dryer appliance 10 defines a vertical direction V, a lateral direction L, and a transverse direction T. The vertical direction V, lateral direction L, and transverse direction T are mutually perpendicular and form an orthogonal direction system. Cabinet 12 includes a front panel 14, a rear panel 16, a pair of side panels 18 and 20 spaced apart from each other by front and rear panels 14 and 16, a bottom panel 22, and a top cover 24. Within cabinet 12 is a container or drum 26 which defines a chamber 28 for receipt of articles, e.g., clothing, linen, etc., for drying. Drum 26 extends between a front portion and a back portion, e.g., along the transverse direction T. In example embodiments, drum 26 is rotatable, e.g., about an axis that is parallel to the transverse direction T, within cabinet 12. A door 30 is rotatably mounted to cabinet 12 for providing selective access to drum 26.

An air handler 32, such as a blower or fan, may be provided to motivate an airflow (not shown) through an entrance air passage 34 and an air exhaust passage 36. Specifically, air handler 32 may include a motor 38 which may be in mechanical communication with a blower fan 40, such that motor 38 rotates blower fan 40. Air handler 32 is configured for drawing air through chamber 28 of drum 26, e.g., in order to dry articles located therein, as discussed in greater detail below. In alternative example embodiments, dryer appliance 10 may include an additional motor (not shown) for rotating fan 40 of air handler 32 independently of drum 26.

Drum 26 may be configured to receive heated air that has been heated by a heating assembly 50, e.g., in order to dry damp articles disposed within chamber 28 of drum 26. Heating assembly 50 includes a heater 52 that is in thermal communication with drying chamber 28. For instance, heater 52 may include one or more electrical resistance heating elements or gas burners, for heating air being flowed to chamber 28. As discussed above, during operation of dryer appliance 10, motor 38 rotates fan 40 of air handler 32 such that air handler 32 draws air through chamber 28 of drum 26. In particular, ambient air enters an air entrance passage defined by heating assembly 50 via an entrance 54 due to air handler 32 urging such ambient air into entrance 54. Such ambient air is heated within heating assembly 50 and exits heating assembly 50 as heated air. Air handler 32 draws such heated air through an air entrance passage 34, including inlet duct 56, to drum 26. The heated air enters drum 26 through an outlet 58 of duct 56 positioned at a rear wall of drum 26.

Within chamber 28, the heated air can remove moisture, e.g., from damp articles disposed within chamber 28. This internal air flows in turn from chamber 28 through an outlet assembly positioned within cabinet 12. The outlet assembly generally defines an air exhaust passage 36 and includes a vent duct 60, air handler 32, and an exhaust conduit 62. Exhaust conduit 62 is in fluid communication with vent duct 60 via air handler 32. More specifically, exhaust conduit 62 extends between an exhaust inlet 64 and an exhaust outlet 66. According to the illustrated embodiment, exhaust inlet 64 is positioned downstream of and fluidly coupled to air handler 32, and exhaust outlet 66 is defined in rear panel 16 of cabinet 12. During a dry cycle, internal air flows from chamber 28 through vent duct 60 to air handler 32, e.g., as an outlet flow portion of airflow. As shown, air further flows through air handler 32 and to exhaust conduit 62.

The internal air is exhausted from dryer appliance 10 via exhaust conduit 62. In some embodiments, an external duct (not shown) is provided in fluid communication with exhaust conduit 62. For instance, the external duct may be attached (e.g., directly or indirectly attached) to cabinet 12 at rear panel 16. Any suitable connector (e.g., collar, clamp, etc.) may join the external duct to exhaust conduit 62. In residential environments, the external duct may be in fluid communication with an outdoor environment (e.g., outside of a home or building in which dryer appliance 10 is installed). During a dry cycle, internal air may thus flow from exhaust conduit 62 and through the external duct before being exhausted to the outdoor environment.

In exemplary embodiments, vent duct 60 may include a filter portion 68 which includes a screen filter or other suitable device for removing lint and other particulates as internal air is drawn out of drying chamber 28. The internal air is drawn through filter portion 68 by air handler 32 before being passed through exhaust conduit 62. After the clothing articles have been dried (or a drying cycle is otherwise completed), the clothing articles are removed from drum 26, e.g., by accessing chamber 28 by opening door 30. The filter portion 68 may further be removable such that a user may collect and dispose of collected lint between drying cycles.

One or more selector inputs 80, such as knobs, buttons, touchscreen interfaces, etc., may be provided on a cabinet backsplash 82 and may be in communication with a processing device or controller 84. Signals generated in controller 84 operate motor 38, heating assembly 50, and other system components in response to the position of selector inputs 80. Additionally, a display 86, such as an indicator light or a screen, may be provided on cabinet backsplash 82. Display 86 may be in communication with controller 84, and may display information in response to signals from controller 84.

As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements (e.g., non-transitory storage media). In some such embodiments, the memory elements include electrically erasable, programmable read only memory (EEPROM). Generally, the memory elements can store information accessible processing device, including instructions that can be executed by processing device. Optionally, the instructions can be software or any set of instructions and/or data that when executed by the processing device, cause the processing device to perform operations. For certain embodiments, the instructions include a software package configured to operate appliance 10 and execute certain cycles or operating modes.

In some embodiments, dryer appliance 10 also includes one or more sensors that may be used to facilitate improved operation of dryer appliance. For example, dryer appliance 10 may include one or more temperature sensors 90. Temperature sensor 90 is generally operable to measure internal temperatures in dryer appliance 10. In some embodiments, temperature sensor 90 is disposed proximal to an outlet of drum 26 (e.g., within vent duct 60). In additional or alternative embodiments, a temperature sensor 90 is disposed along exhaust conduit 62, in thermal communication therewith. For example, temperature sensor 90 may extend at least partially within passage 36 to measure the temperature of air therethrough. In further additional or alternative embodiments, a temperature sensor 90 may be disposed at any other suitable location within dryer appliance 10 to detect the temperature of airflow (e.g., downstream from chamber 28). Temperature sensor 90 may be embodied as a thermistor, thermocouple, or any other suitable sensor for detecting a specific temperature value of air within appliance 10. When assembled, temperature sensor 90 may be in communication with (e.g., electrically coupled to) controller 84, and may transmit readings to controller 84 as required or desired.

In addition, dryer appliance 10 may include one or more airflow sensors 92 which are generally operable to detect the velocity of air (e.g., as an air flow rate in meters per second, or as a volumetric velocity in cubic meters per second) as it flows through the appliance 10. According to the illustrated embodiment, airflow sensor 92 is at least partially positioned within inlet duct 56, e.g., at or proximal to an inlet of drum 26. Additionally or alternatively, airflow sensor 92 may be positioned at another suitable location, such as within exhaust conduit 62, vent duct 60, and/or another portion of inlet duct 56. Airflow sensor 92 may be embodied by any suitable configuration (e.g., mechanical flow meter, pressure-based meter, optical meter, etc.), such as a Pitot tube or a set of dual static-pressure taps connected to a pressure transducer. When assembled, airflow sensor 92 may be in communication with (e.g., electrically coupled to) controller 84, and may transmit readings to controller 84 as required or desired.

In some embodiments, controller 84 is configured to vary operation of heating assembly 50 based on one or more temperatures detected at temperature sensor 90 or air flow measurements from airflow sensor 92. For instance, controller 84 may automatically set or adjust one or more criteria for activation heating assembly 50 without an estimation of ambient conditions by a user. Specifically, controller 84 may determine an ambient temperature and set or adjust a threshold criterion accordingly. During use, controller 84 can initiate a temperature-contingent dryer cycle wherein a determination about the ambient conditions (e.g., ambient air temperature) is made, and operation of the appliance 10 is modified accordingly.

Referring now to FIGS. 3 through 6, a system and method for introducing a fragrance into drying chamber 28 (and thus the clothes drying therein) will be described according to an exemplary embodiment of the present subject matter. Although exemplary systems and methods of introducing a fragrance are described as being used in dryer appliance 10, it should be appreciated that aspects of the present subject matter may be used for introducing fragrance in any other suitable appliance. In this regard, the exemplary embodiment described herein is not intended to limit the scope of the present subject matter.

In general, dryer appliance 10 includes a reservoir 100 (see, e.g., FIGS. 5 and 6) positioned within cabinet 12 for receipt of a fragrant additive 102. As used herein, "fragrant additive" is used to refer to any product, material, or composition that may be deposited into reservoir 100 for generating a particular scent, smell, or fragrance when a flow of air (indicated herein by reference numeral 104) passes therethrough or otherwise interacts with the fragrant additive. Specifically, for example, the fragrant additive may be a bar of soap, scented pellets, aroma beads, or other liquid or non-liquid scented materials that generate a fresh, desired scent within the flow of air 104 passing therethrough. The present subject matter is not intended to be limited to any particular type or scent of the fragrant additive 102.

To permit the flow of air 104 to entrain the aroma or scent from the fragrant additive 102, reservoir 100 generally defines one or more openings 106 through which the flow of air 104 may pass into and/or out of reservoir 100. Alternatively, reservoir 100 may define a dedicated inlet and outlet or opening 106, as described below according to an exemplary embodiment. In addition, dryer appliance 10 includes an air circulation device 108 that is generally configured for urging the flow of air 104 through the openings 106 and into cabinet 12. In this manner, during operation of dryer appliance 10, air circulation device 108 may generate the flow of air 104 which may pass into and/or out of reservoir 100 and into drying chamber 28 to provide a distinct aroma to clothing articles positioned therein.

Notably, according to various embodiments of the present subject matter, reservoir 100 may have any suitable size, configuration, and position within cabinet 12. In addition, air circulation device 108 may generally be any device that is configured for generating a flow of air. Referring to FIGS. 3 through 6, two exemplary configurations of reservoir 100 and air circulation device 108 are described according to exemplary embodiments. However, it should be appreciated that these embodiments are only used to describe exemplary aspects of the present subject matter and are not intended to limit the scope of the present invention. Indeed, other means for circulating air through the fragrant additive are possible and within the scope of the present subject matter.

Figure 3:
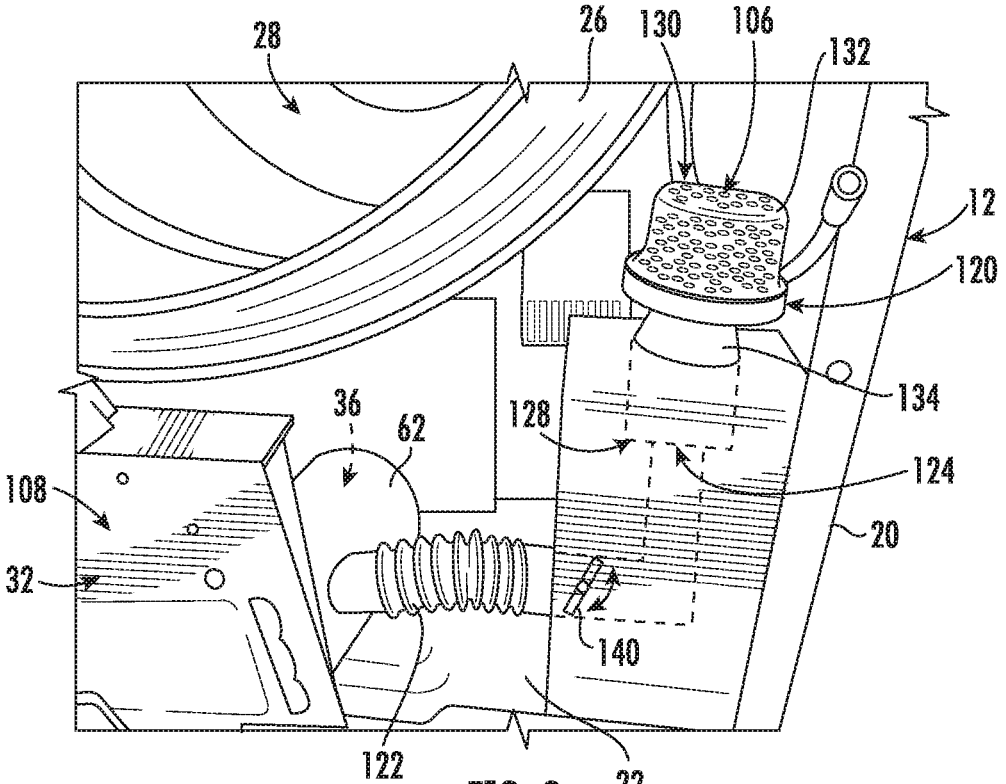
FIG. 3 provides a perspective view of a fragrant additive reservoir that may be used with the exemplary dryer appliance of FIG. 1 according to an exemplary embodiment of the present subject matter.
Figure 4:
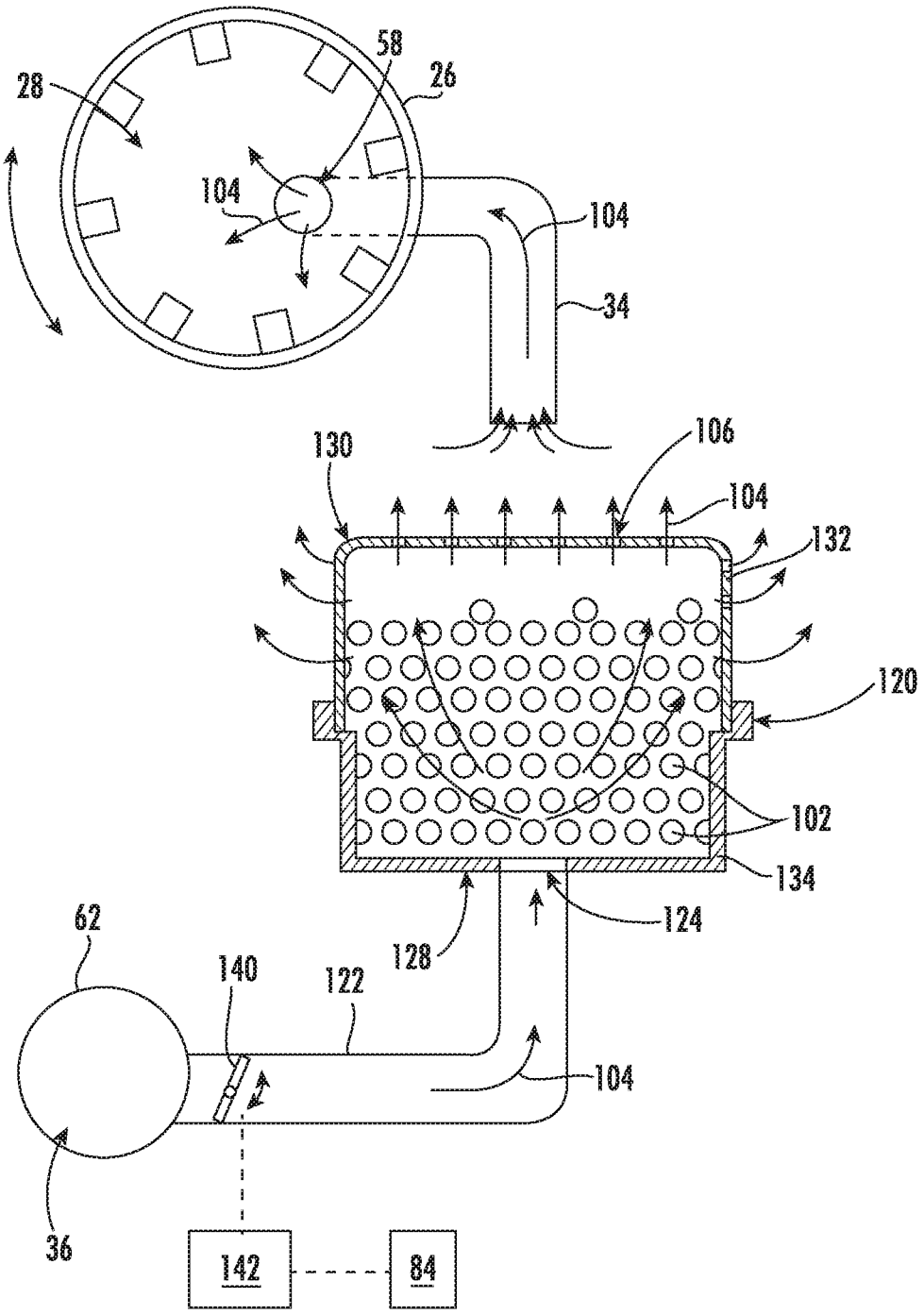
FIG. 4 provides a schematic view of the exemplary fragrant additive reservoir of FIG. 3 in fluid communication with an exhaust conduit of the exemplary dryer appliance of FIG. 1 according to another exemplary embodiment of the present subject matter.

Referring now specifically to FIGS. 3 and 4, an exemplary configuration of reservoir 100 and air circulation device 108 are provided according to an exemplary embodiment the present subject matter. Specifically, FIG. 3 provides a perspective view of dryer appliance 10 with front panel 14 from moved to reveal a reservoir 120 (e.g., similar to reservoir 100 described generally above). In addition, FIG. 4 provides a schematic view of the path of the flow of air 104 through reservoir 120 and into drying chamber 28. It should be appreciated that modifications and variations may be made to this exemplary configuration while remaining within the scope of the present subject matter.

As explained above, dryer appliance 10 includes an exhaust conduit 62 that extends between air handler 32 and exhaust outlet 66 for discharging air from within drying chamber 28 to the outdoor environment. According to this exemplary embodiment, air circulation device 108 comprises air handler 32 which is fluidly coupled to exhaust conduit 62 for urging the flow of air 104 through exhaust passage 36. In addition, dryer appliance 10 includes a bypass conduit 122 which extends between and fluidly couples exhaust passage 36 to reservoir 120. More specifically, according to the illustrated embodiment, bypass conduit 122 is fluidly coupled to an inlet 124 of reservoir 120 such that the flow of air 104 passes into inlet 124, through fragrant additive 102, out openings 106 of reservoir 120, and into cabinet 12.

According to the illustrated embodiment, inlet 124 is positioned on a bottom 128 of reservoir 120 along the vertical direction V and openings 106 are defined on a top 130 of reservoir 120 such that the flow of air 104 generally passes up through fragrant additive 102 and out into cabinet 12. In addition, reservoir 100 may include a mesh screen 132 that defines the one or more openings 106 through which the flow of air 104 may pass. According to the illustrated embodiment, a bottom portion 134 of reservoir 120 is constructed of solid plastic and mesh screen 132 sits on top of bottom portion 134 to help contain fragrant additive 102. However, it should be appreciated that according to alternative embodiments, reservoir 120 may be constructed of a single piece of plastic with holes punched in it, or alternatively may be constructed entirely of a single mesh screen, a mesh bag, or any other suitable housing for containing fragrant additive 102 while permitting the flow of air 104 to pass therethrough.

Notably, in certain situations it may be desirable to prevent the introduction of scent or smells into dryer chamber 28. For example, it is frequently desirable to introduce smells only during the final stages of a drying cycle, e.g., such as a fluff portion of the drying cycle when a heating element (e.g., such as heater 52) is turned off. Therefore, dryer appliance 10 may include various flow regulating features for controlling the flow of air 104 and/or closing off reservoir 120 when the introduction of such scents is not desired. Several exemplary flow regulating features are described below, but are not intended to limit the scope of the present subject matter.

Referring now specifically to FIG. 4, dryer appliance 10 may further include a bypass valve 140 that is operably coupled with bypass conduit 122 for regulating the flow of air 104 into reservoir 120. Specifically, according to the illustrated embodiment, bypass valve 140 is a butterfly valve that is positioned proximate a junction between bypass conduit 122 and exhaust conduit 62. In addition, bypass valve 140 may be regulated by motor 142 which is an operative communication with controller 84. In this manner, controller 84 may be programmed to selectively open, close, or otherwise positioned bypass valve 140 to regulate the flow of air 104 and/or the amount of scent introduced into cabinet 12 and drying chamber 28. Although bypass valve 140 is illustrated as being positioned at the junction of exhaust conduit 62 and bypass conduit 122, it should be appreciated that bypass valve 140 may positioned at any suitable location and may be any suitable valve type and configuration.

It is frequently desirable to introduce scent or smell into drying chamber 28 only when certain operating conditions exist or in response to a user input. Therefore, according to exemplary embodiments of the present subject matter, bypass valve 140 and motor 142 may be coupled to controller 84 and opened only when a specific set of operating parameters exist, e.g., such as when heater 52 is off and drum 26 is spinning. In addition, the position of bypass valve 140 may be regulated to selectively adjust the scent strength for particular condition or upon user request. In this regard, for example, a user may select a strong scent setting (such that bypass valve 140 is fully open), a mild scent setting (such that bypass valve 140 is partially open), a no scent setting (such that bypass valve 140 is fully closed), or any other suitable position there between.

In addition, the strength of the scent provided by fragrant additive 102 may depend on the position of reservoir 120 within cabinet 12. For example, reservoir 120 may be positioned proximate an inlet to drying chamber 28. More specifically, referring to FIG. 2, reservoir 120 may be positioned proximate entrance 54 of air entrance passage 34. In this manner, fragrant flow of air 104 may exit openings 106 and pass directly into entrance 54 to obtain the strongest smell with the least dilution within drying chamber 28. Alternatively, reservoir 120 may be positioned at any other suitable location within cabinet 12, e.g., such as within regions where the flow of air 104 tends to be strongest. According to still another embodiment, opening 106 may be directly fluidly coupled to entrance 54 for providing the flow of air 104 directly into air entrance passage 34.

Figure 5:
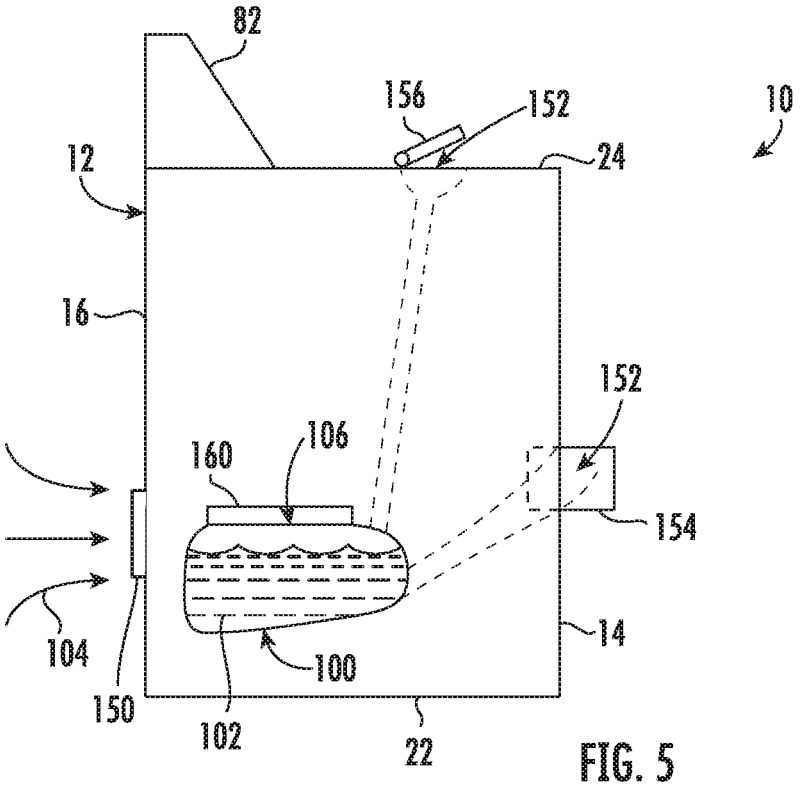
FIG. 5 provides a schematic view of a fragrant additive reservoir in a dryer appliance according to another exemplary embodiment of the present subject matter.

Although air circulation device 108 as described above as being air handler 32, it should be appreciated that air circulation device 108 may be any other suitable component within dryer appliance 10 that generates the flow of air 104 sufficient to entrain scent from fragrant additive 102. For example, according to another embodiment of the present subject matter, air circulation device 108 may be drum 26 which has a natural tendency to circulate air as it spins. For example, as illustrated in FIG. 5, rear panel 16 cabinet 12 may define an inlet 150 through which the flow of air 104 may be drawn as drum 26 spins. In this manner, reservoir 100 may be positioned at a location proximate drum 26 such that drum 26 spins to generate a flow of air 104 which passes into and/or out of reservoir 100 and draws the flow of scented air 104 into drying chamber 28.

Dryer appliance 10 may further include one or more refill inlets 152 through which fragrant additive 102 may be introduced or resupplied to reservoir 100, 120 as needed. Specifically, referring for example to FIG. 5, refill inlets 152 may be a sliding drawer 154 positioned on front panel 14 of the cabinet 12 or may be a hinged door 156 positioned on top cover 24 of cabinet 12. Although two exemplary refill inlets 152 are described herein, it should be appreciated that any suitable position, type, and configuration of refilling mechanisms are possible and within the scope of the present subject matter.

Figure 6:
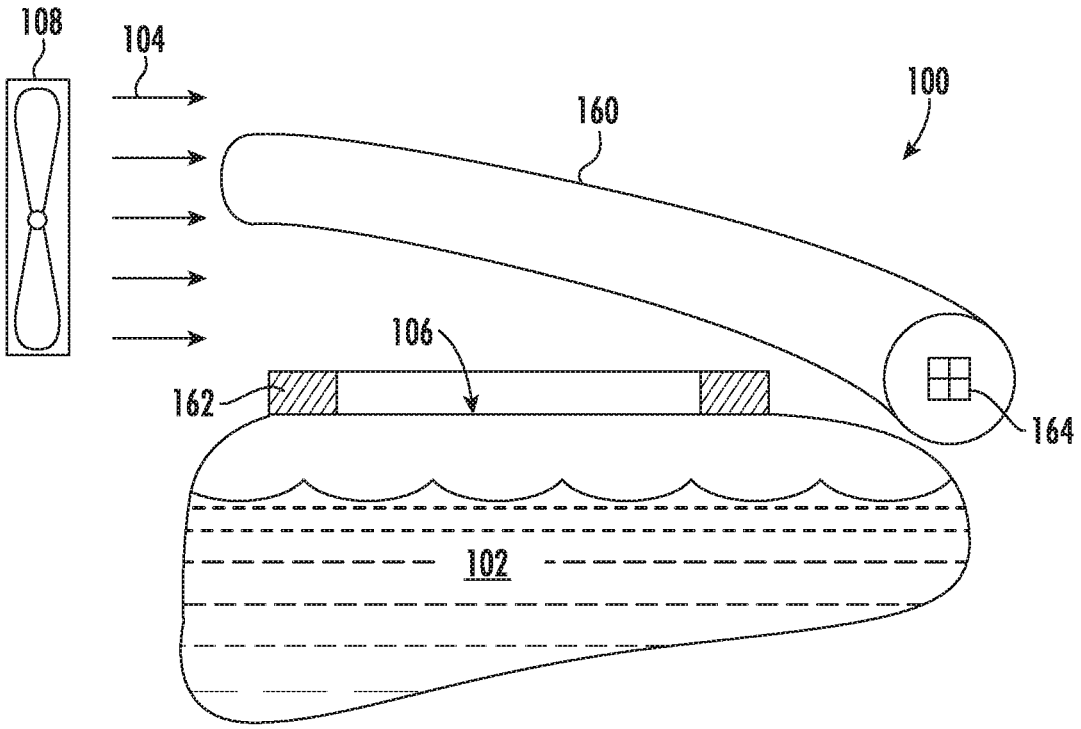
FIG. 6 provides a schematic view of a fragrant additive reservoir according to another exemplary embodiment of the present subject matter.

Referring now specifically to FIGS. 5 and 6, a general representation of reservoir 100 for containing fragrant additive 102 will be described according to another exemplary embodiment of the present subject matter. As illustrated, reservoir 100 is a substantially closed container having a single opening 106. In addition, reservoir 100 may include a lid 160 that is pivotally attached to reservoir 100 and is configured for opening and closing as needed to regulate the scent strength. In addition, in order to prevent scent from fragrant additive 102 from reaching drying chamber 28 when not desired, a seal 162 may be positioned around opening 106 between lid 160 and reservoir 100.

According to the illustrated embodiment of FIG. 6, lid 160 is a single pivoting member is operably coupled to a motor 164. However, it should be appreciated that according to alternative embodiments, lid 160 may comprise a set of louvers that are coupled to an actuating arm driven by motor 164. In this manner, motor 164 is generally configured for positioning lid 160 in the desired angular position in order to achieve the desired scent strength, e.g., as set by a user or determined by controller 84.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a drying chamber for receipt of clothes for drying;

an exhaust conduit defining an exhaust passage in fluid communication with the drying chamber;

a reservoir positioned within the cabinet for receipt of a fragrant additive, the reservoir defining one or more openings;

a bypass conduit providing fluid communication between the exhaust passage and the reservoir; and an air circulation device for urging a flow of air through the bypass conduit and the one or more openings and into the cabinet.

2. The dryer appliance of claim 1, wherein the air circulation device is an air handler that is fluidly coupled to the exhaust conduit for urging the flow of air through the exhaust passage.

3. The dryer appliance of claim 1, wherein an inlet of the reservoir is positioned on a bottom of the reservoir along a vertical direction and is fluidly coupled to the bypass conduit.

4. The dryer appliance of claim 1, wherein the one or more openings of the reservoir are defined by a mesh screen that contains the fragrant additive.

5. The dryer appliance of claim 1, wherein a bypass valve is operably coupled with the bypass conduit for regulating the flow of air into the reservoir.

6. The dryer appliance of claim 5, wherein the bypass valve opens only when a heating element of the dryer appliance is off.

7. The dryer appliance of claim 5, wherein the bypass valve is selectively adjusted in response to a user requested scent strength.

8. The dryer appliance of claim 1, wherein the reservoir is positioned proximate an entrance to an air entrance passage.

9. The dryer appliance of claim 1, wherein the cabinet defines a refill inlet for filling the reservoir with the fragrant additive.

10. The dryer appliance of claim 9, wherein the refill inlet is a sliding drawer positioned on a front of the cabinet or a hinged door positioned on a top of the cabinet.

11. The dryer appliance of claim 1, wherein the air circulation device is the drum which circulates the flow of air while rotating.

12. The dryer appliance of claim 1, comprising:

a lid positioned over the one or more openings for selectively opening and closing the reservoir.

13. The dryer appliance of claim 12, comprising:

a seal positioned between the reservoir and the lid to create a substantially airtight seal over the one or more openings when the lid is closed.

14. The dryer appliance of claim 12, comprising:

an electric motor operably coupled to the lid for selectively positioning the lid to regulate a scent strength in the drying chamber from the additive fragrance.

15. The dryer appliance of claim 14, wherein the lid comprises a set of louvres.

16. A dryer appliance comprising:

a cabinet;

a drum rotatably mounted within the cabinet, the drum defining a drying chamber for receipt of clothes for drying;

an exhaust conduit defining an exhaust passage in fluid communication with the drying chamber;

an air handler operably coupled to the exhaust conduit for urging a flow of air through the exhaust passage;

a reservoir positioned within the cabinet for receipt of a fragrant additive, the reservoir defining an inlet and one or more openings; and a bypass conduit providing fluid communication between the exhaust passage and the inlet of the reservoir such that the flow of air passes through the fragrant additive and out the one or more openings of the reservoir into the cabinet.

17. The dryer appliance of claim 16, wherein the inlet is positioned on a bottom of the reservoir along a vertical direction.

18. The dryer appliance of claim 16, wherein the one or more openings of the reservoir are defined by a mesh screen that contains the fragrant additive.

19. The dryer appliance of claim 16, wherein a bypass valve is operably coupled with the bypass conduit for regulating the flow of air into the reservoir.

* * * * *